United States Patent [19]

Danis

[11] 4,050,250

[45] Sept. 27, 1977

[54] HEAT TRANSFER ELEMENT

[75] Inventor: Louis J. Danis, Battle Creek, Mich.

[73] Assignee: Eaton Corporation, Cleveland, Ohio

[21] Appl. No.: 627,423

[22] Filed: Oct. 30, 1975

[51] Int. Cl.[2] ..... F02G 1/04

[52] U.S. Cl. ..... 60/517; 138/140; 138/177; 165/104 R

[58] Field of Search ..... 60/517, 524; 165/104 R; 138/38, 114, 140, 177

[56] References Cited

U.S. PATENT DOCUMENTS

| | | | |
|---|---|---|---|
| 1,672,036 | 6/1928 | Oltman | 165/104 R |
| 2,913,009 | 11/1959 | Kuthe | 165/179 X |
| 3,062,507 | 11/1962 | Andrus | 165/104 R |
| 3,808,815 | 5/1974 | Friedemann | 60/517 |
| 3,823,769 | 7/1974 | Anderson et al. | 165/104 X |
| 3,861,146 | 1/1975 | Lynch et al. | 60/524 |

FOREIGN PATENT DOCUMENTS

| | | | |
|---|---|---|---|
| 2,236,814 | 1/1974 | Germany | 165/104 R |

*Primary Examiner*—Irwin C. Cohen
*Attorney, Agent, or Firm*—Teagno & Toddy

[57] ABSTRACT

A heater head for use in hot gas engine is formed using improved heat transfer structures. The heat transfer structures used in the heater head are formed of an oxidation resistant enclosure enclosing a tube of high strength, gas impermeable material. A chamber is formed between the enclosure and the tube, and filled with a metal or alloy which is liquid at the operating temperature of the heater head. The structure transfers combustion heat rapidly from the oxidation resistant metal to the strong, gas impermeable tube via the liquid metal. The strong gas impermeable tube is filled with working gas, such as hydrogen or helium maintained at a high pressure.

10 Claims, 4 Drawing Figures

HEAT TRANSFER ELEMENT

BACKGROUND OF THE INVENTION

1. Field of the Invention

In one aspect, this invention relates to heat transfer elements useful in hot gas containment. In a further aspect, this invention is related to heater heads for use in hot gas engines.

2. Description of the Prior Art

Present hot gas engines, especially Stirling Engines, commonly have a heater head comprising a plurality of small diameter metal heater pipes formed into a complex array. The pipes are brazed or welded to form a closed loop. The array of heater pipes is filled with a pressurized working gas maintained at a high pressure, e.g., 150–200 atmospheres.

During operation, combustion gases are passed over the heater pipes; a portion of the combustion gases' heat is transferred to the working gas by conduction through the metal pipe. Alternate heating and cooling of the working gas drives a power piston.

The combustion gases in a combustion engine may be highly oxidizing because of the large amounts of oxygen and carbon monoxide present. The combustion gases also contain sulfur oxides and heavy metal oxides. Thus, the heater pipe surface exposed to the combustion gases must be resistant to oxidation and corrosive attack by oxygen sulfur and oxides.

The pressure of the working gas requires that the heater pipes also withstand high internal pressures at elevated temperatures, e.g., 1300°–1400° F (about 705°–760° C). The combination of high pressure and heat require a strong creep resistant material to contain the working gas.

Also, the pipe must retain the gas at the working temperatures and pressures. This requires that the pipe material have a low gas permeability. Because helium and hydrogen are generally used as the working gases, the heater pipe must be relatively dense and impermeable. Hydrogen is the preferred gas and therefore, it is desirable that the pipe be impermeable to hydrogen.

The combination of oxidizing atmosphere and high creep conditions severely limits the possible materials and operating temperatures of present engines. For example, stainless steel which has good oxidation and corrosion resistance has a high creep rate when operated continuously at 650° C and 100 atmospheres pressure. Molybdenum and tungsten maintain their strength and creep resistance at high temperatures up to 1500° C or more but are rapidly attacked by oxygen and oxides making their useful life very short.

Because of such material limitations, the prior art heater pipes could only operate at low operating temperatures of 1300°–1400° F and had a low heat transfer coefficient.

Because of their low heat transfer characteristics many heater pipes were needed in prior art systems. There were often several dozen heater pipes per cylinder. Assembling the heater head required the forming and sealing of the dozens of heater pipes to form a substantially hydrogen impermeable structure. The processing costs of forming such a heater head are substantial.

The more efficient operation possible with applicant's heater pipe provides a heater head with fewer heater pipes and results in a less complex structure. Also, the less complex structure is less expensive to assemble.

SUMMARY OF THE INVENTION

It is an object of this invention to produce an easily assembled, low cost head transfer structure.

A further object of this invention is to provide a heater head for use in hot gas engines having improved thermal transfer properties.

It is yet a further object of this invention to provide a heater head suitable for operating at higher operating temperatures than presently available heater heads.

A primary feature of this invention is the provision of a heater pipe suitable for use in heater heads mounted on an engine block. The heater pipe includes an enclosure having an outer surface suitable for exposure to hot combustion gases and an internal cavity. A gas impermeable, high strength container is disposed within the cavity. The container and enclosure are sealed to form a chamber and a low melting temperature metal or alloy is used in the chamber to facilitate conductive heat transfer from the enclosure to the container.

A working gas is maintained at elevated pressure within the high strength container, the working gas being in fluid communication with the power piston of the heat engine.

In this structure, the outer enclosure is exposed to the combustion gases but not to the high pressure of the working gas. The enclosure will normally operate in the range of 5 to 15 atmospheres. Therefore, well known high temperature alloys which resist oxidation can be used to make the enclosure since the creep problems are not especially severe. This allows the use of relatively inexpensive iron and nickel based alloys which are more oxidation resistant than the alloys which have been heretofore used. Also, the high temperature alloys allow higher operating temperatures because the material can be selected for good high temperature oxidation properties.

Because the gas impermeable, high strength container is disposed within the enclosure, the container is not exposed to oxidizing conditions. Therefore, the container can be made from materials strong at high temperature and pressures, such as refractory metals, which are not suitable for use in an oxidizing atmosphere. The container's high strength makes it creep resistant at pressures up to about 200 atmospheres and temperatures of about 2000°–2200° F. The container is substantially gas impermeable, that is, the container will not allow an appreciable loss of the working gas during the expected operating life of the engine.

The chamber formed by joining the enclosure and the tube contains a metal or alloy which becomes a liquid at the operating temperature of the heat transfer structure and provides a good means for heat transfer from the enclosure to the tube. Such metals and alloys are collectively referred to hereinafter as low temperature metals.

The combination of materials used allows the use of an inexpensive simple structure which was not previously useable in heater pipes and improves the operating efficiency of the engine by allowing operation at higher temperatures than has previously been possible.

As a further feature of this invention a heater pipe for use in a Stirling engine heater is formed. The heater pipe contains a working gas. The heater pipe comprises in part an enclosure with an outer or exterior surface which is exposed to hot combustion gas and an internal bore. A tube adapted to contain the working gas is disposed within the enclosure. The tube is relatively impermeable to the working gas and has a relatively high strength to withstand the working gas pressure. The enclosure and tube form a closed-ended chamber which is filled with a low melting temperature metal which will transfer heat from the enclosure to the tube primarily by conduction through the liquid.

The combination of materials in the heater pipe provides the advantages discussed hereinbefore with respect to the heat transfer element.

As yet a further feature, the enclosure can have an extended outer surface exposed to the combustion gases. Such surfaces can be provided by fins or corrugations on the outer surface of the enclosure and present a large surface for heat absorption by the enclosure. The corrugations allow some flexing of the outer surface as it is heated.

Where the heat transfer structure is a heater pipe for use in Stirling engines the extended outer surface can provide a large surface area. Indeed, the surface ratio of the outer surface, exposed to the combustion gas, to the inner surface of the high strength tube, exposed to the working gas, can be a factor of 3 to 1, or more. Ratios of 10 to 1 are easily obtainable. This allows large amounts of heat energy to be absorbed by the enclosure and transferred via the liquid metal to the working gas which, in turn, results in a more efficient heater head. Because the exposed area of the enclosure is large, fewer heater pipes are necessary to form an operable heater head. Consequently, fewer joints are required which decreases the cost of assembling the heater head and provides fewer places for possible failure. In fact, where small diameter cylinders are used in the hot gas engine, the heater head could consist of one element for each cylinder.

As yet a further feature, a heater pipe of this invention can have associated therewith a combustion chamber disposed at a position remote from the heater pipe for the combustion of fuel, a transport tube communicating at opposite ends with a liquid metal chamber in said heater pipe for carrying heater liquid metal into the liquid metal chamber. The transport tube and liquid metal chamber form a closed loop through which a liquid metal flows transferring heat from the combustion chamber to the working gas.

By using a remote heating source a large number of heater pipes for a plurality of cylinder heads can be heated by a single combustion chamber. This allows a simpler engine design with consequent decreases in cost and increases in reliability.

DETAILED DESCRIPTION

Figure 1:
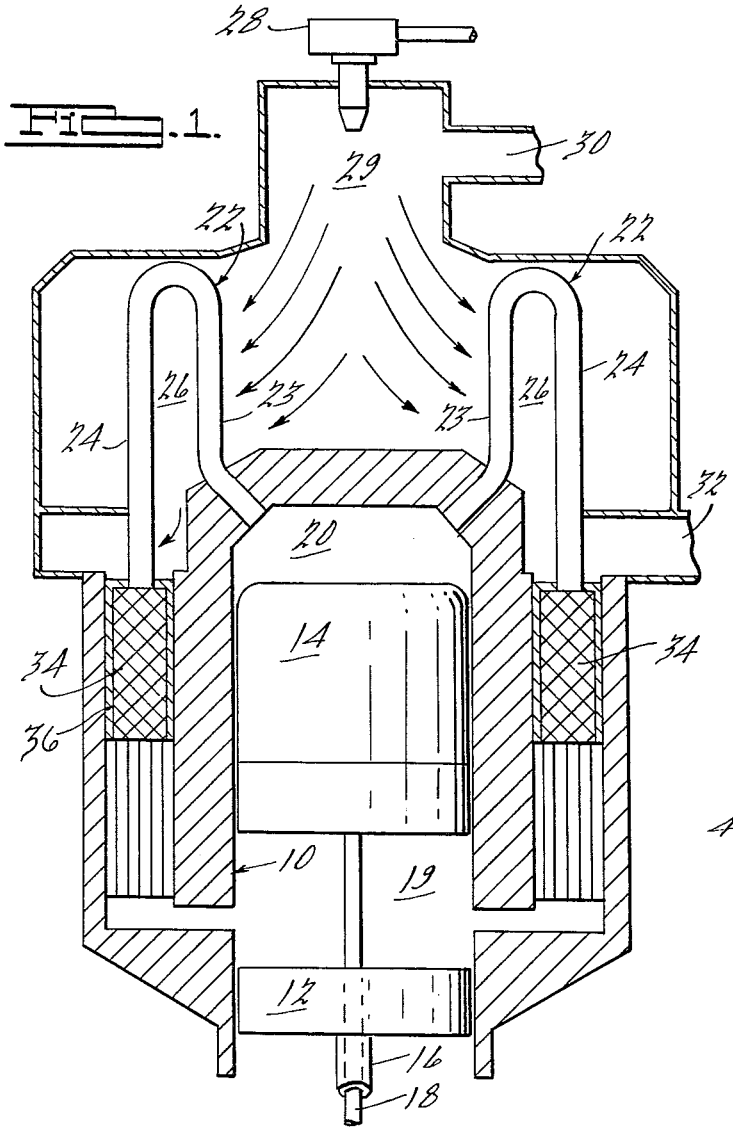
FIG. 1 is a schematic diagram of a Stirling Engine cylinder with a displacer piston, a power piston and associated heat transfer apparatus.

In FIG. 1, a cylinder 10 has a power piston 12 and a displacer piston 14, which move axially within the cylinder in phase difference. The power piston 12 and displacer piston 14 connect to a drive system, such as a rhomboid drive (not shown) by means of a piston rod 16 and a displacer rod 18. A compression space 19 is present between the displacer piston 14 and in fluid communication with an expansion space 20 above the displacer piston.

Heater pipes 22 are arranged so that there is an inner row 23 of pipes and an outer row 24 of pipes, the pipes being arranged in two concentric circular arrays. There is a gap 26 between the pipes of each circular array which serves as a passage for the hot combustion gases.

During operation, a burner 28 dispenses fuel into the burner chamber 29 where the fuel is mixed with air from inlet 30 for combustion. The fuel burns in the combustion chamber 29 and exits via outlet 32.

A regenerator 34 is accommodated within a housing 36. The regenerator 34 absorbs heat from the heated working gas as it passes into the compression zone 19 from the expansion space 20 and releases absorbed heat to the cooled working gas as it is forced back into the expansion space 20 via tubes 22. The regenerator 34 retains a substantial portion of the heat absorbed by the working gas so that heat is not transferred into the cooler compression zone 19.

Figure 2:
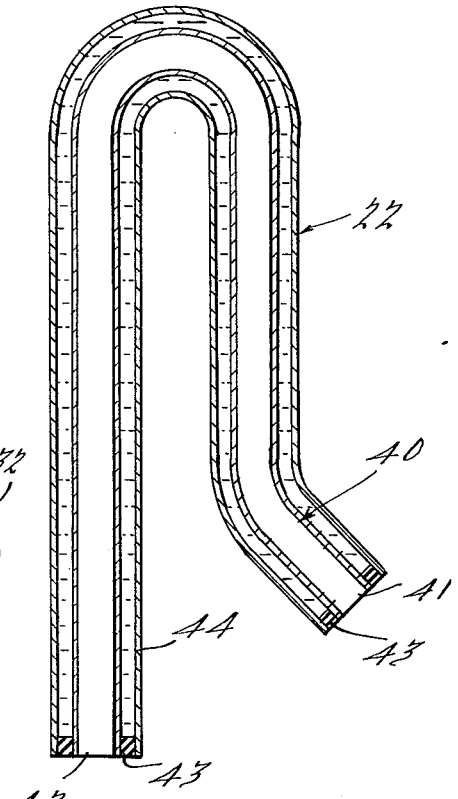
FIG. 2 is an enlarged sectional view of the heat pipe used in FIG. 1.
Figure 3:
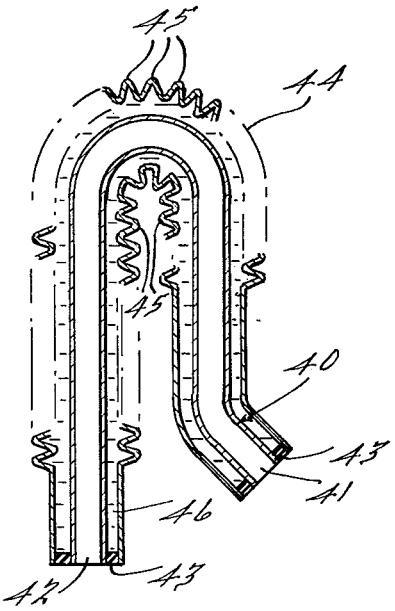
FIG. 3 is an enlarged sectional view of a modified heat pipe suitable for use in Stirling Engines.

An improved heater head is formed by using the improved heater pipes shown in greater detail in FIGS. 2 and 3. In FIGS. 2 and 3 a high strength, gas impermeable tube 40 is formed so that one end 41 of the tube exits into expansion chamber 20 of the cylinder 10. The other end 42 of the tube 40 exits into the regenerator 34. The tube 40 is capable of containing a working gas, such as hydrogen or helium at high pressures. Pressures in the tube 40 are generally 100 to 200 atmospheres ($1.01 \times 10^7$ to $2.02 \times 10^7$ N/m$^2$) or higher at operating temperatures of 2300° F (1260° C). The tube 41 supports the entire force of the working gas and transmits substantially no pressure to its surrounding environment.

The materials generally useful as the tube portion of the heater pipe are metals, alloys or refractories which maintain their strength at high temperatures. Some examples are tungsten, molybdenum, niobium and alloys thereof. Because of its low cost relative to the other refractory metals molybdenum is the preferred metal. Only small amounts of these metals are needed to make the tubes so the expense of using these metals is not prohibitive. These metals have known high strength but the oxidation atmosphere present has prevented their use in Stirling engines.

The curved gas impermeable tube 40 is surrounded by an enclosure 44 made from an alloy resistant to oxidation and corrosion even at elevated temperatures, e.g., up to 2300° F (1260° C). Because the tube 41 bears the pressure of the working gas, the enclosure 44 is subjected to only a mild pressure on the order of 5 to 20 atmospheres ($5.0 \times 10^5$ to $2.02 \times 10^5$ N/m$^2$). Therefore, creep is not a severe problem compared with prior art devices. This allows the enclosure materials to be selected primarily on the basis of oxidation resistance and increases the number of materials available. The enclosure can be formed from numerous oxidation resistant alloys, such as stainless steels. Also useable are corrosion resistant nickel and cobalt alloys many of which are less expensive than the high temperature creep resistant alloys presently used. Also small quantities of the materials can be used allowing the use of expensive materials without a corresponding rise in cost of the finished tube.

As shown in FIG. 3, the enclosure 44 can be corrugated to provide a plurality of fins 45 herein shown as radial fins, although longitudinal fins are also acceptable. The outer surfaces of fins 45 provide an extended surface area for absorbing heat from the combustion gases. The extended surface can easily provide up to 10 times as much surface area as a normal smooth surface which gives the corrugated surface greatly increased heat absorption capacity.

The enclosure 44 and tube 40 are sealed at the ends 41, 42, such as by brazing a plug 43 between the enclosure and tube to form a chamber 46. The chamber 46 is filled with a low melting temperature metal or alloy which will be liquid at the operating temperature of the engine. As used herein metal includes both pure metals and alloys. The liquid metal transports heat efficiently from the enclosure 44 to the gas filled tube 40. The preferred low melting temperature metals are the alkali metals, e.g., lithium, sodium, potassium and alloys thereof. These metals liquify rapidly at temperatures well below engine operating temperatures and have proved to be good means for heat conduction. Of course the metal or alloy can vary as other operating temperature changes. A high operating temperature makes many metals or alloys feasible.

Figure 4:
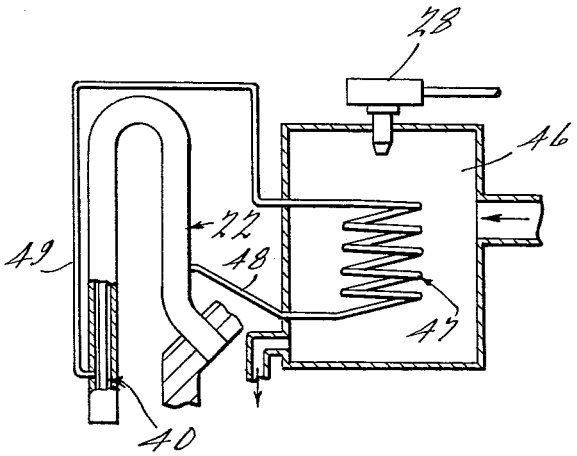
FIG. 4 is a schematic view of a heat pipe having a remote combustion chamber.

The embodiment in FIG. 4 shows a heater pipe 22 separated from a combustion chamber 46. The combustion chamber 46 has a coil 47 of oxidation resistant metal filled with a low melting temperature metal the coil being exposed to combustion gases. The heated metal can flow through line 48 to chamber 46 in the tube 22 and after passing through the chamber exit the chamber via a line 49 to be returned to the combustion chamber for reheating. This heater pipe 22 works in a manner similar to the heater pipes shown in FIGS. 2 and 3 with the additional advantage that the combustion chamber 46 can be located at a point remote from the heater pipes. Thus, one combustion chamber can service a plurality of cylinders.

Various alterations and modifications of this invention will become apparent to those skilled in the art without departure from the scope and spirit of this invention. It is to be understood that this invention is not limited to the illustrative embodiments set forth hereinbefore.

What is claimed is:

1. In combination, a Stirling cycle hot gas reciprocating engine and a heat transfer element for transferring heat formed by the combusting fuel to the pressurized contained working gas comprising:

an enclosure having an outer surface exposed to the hot gases caused by said combustion and defining an internal cavity;

a relatively gas impermeable, high strength container located within the cavity to hold the pressurized working gas to be heated; and a low melting temperature metal disposed in the chamber defined between the inner surface of the enclosure and the outer surface of the container, the metal being a liquid at the operating temperature of the heat transfer element.

2. A heater pipe according to claim 1 wherein said engine includes a heater head and the heater head includes a combustion chamber disposed at a location remote from said heat transfer element and a transport tube communicating at its opposite ends with the opposite ends of the liquid metal chamber and passing intermediate its ends through said combustion chamber, said tube forming with said liquid metal chamber a closed loop through which heated liquid metal may flow from said combustion chamber to said liquid metal chamber and cooled liquid metal may return to the combustion chamber.

3. The heater pipe of claim 2 where the low temperature melting metal is lithium.

4. In combination, a Stirling cycle hot gas reciprocating engine and a heater pipe in the combustion chamber of the heater head mounted on the engine block of the hot gas engine, the pipe containing a pressurized working gas being joined to the heater head and in fluid communication with the power piston of the hot gas engine, said pipe comprising:

an elongated metal enclosure having an outer surface and an internal bore;

a tube located within the bore of the enclosure and adapted to contain the working gas therewithin, the tube being relatively impervious to the working gas and having a relatively high tensile strength to withstand the working gas pressure and the enclosure and tube being joined near their ends to form a closed-ended chamber; and a low melting temperature metal disposed in the chamber to transfer heat therethrough from the metal enclosure to the tube.

5. The heater pipe of claim 4 where the enclosure has a corrugated outer surface defining a plurality of radially disposed fins, thereby presenting an extended exposed surface for heat absorption.

6. The heater pipe of claim 4 where said enclosure is formed from an oxidation resistant iron based alloy.

7. The heater pipe of claim 4 where said enclosure is formed from an oxidation resistant nickel based alloy.

8. The heater pipe of claim 4 where the low melting metal is an alkali metal or alloy thereof.

9. The heater pipe of claim 4 where the low temperature melting metal is sodium.

10. The heater pipe of claim 4 where the low melting temperature metal is an alloy of sodium with an alkali metal.

* * * * *

UNITED STATES PATENT AND TRADEMARK OFFICE

CERTIFICATE OF CORRECTION

PATENT NO. : 4,050,250

DATED : September 27, 1977

INVENTOR(S) : Louis J. Danis

It is certified that error appears in the above-identified patent and that said Letters Patent are hereby corrected as shown below:

Col. 2, line 57: After "low" insert "melting".

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*